US007278803B1

(12) United States Patent
Moreau

(10) Patent No.: US 7,278,803 B1
(45) Date of Patent: Oct. 9, 2007

(54) CORRUGATED ASYMMETRICAL RETAINING WALL PANEL

(76) Inventor: Jeff M Moreau, 225 Town Park Dr., suite 300, Kennesaw, GA (US) 30144

( * ) Notice: Subject to any disclaimer, the term of this patent is extended or adjusted under 35 U.S.C. 154(b) by 0 days.

(21) Appl. No.: 11/515,935

(22) Filed: Sep. 5, 2006

(51) Int. Cl.
*E02D 5/08* (2006.01)

(52) U.S. Cl. ..... 405/274; 405/284; 405/285; 405/279

(58) Field of Classification Search ..... 405/284, 405/285, 274–281
See application file for complete search history.

(56) References Cited

U.S. PATENT DOCUMENTS

| | | | | |
|---|---|---|---|---|
| 972,059 | A | 10/1910 | Clarke | |
| 1,739,108 | A | 12/1929 | Weber | |
| 1,933,483 | A | 10/1933 | Pennoyer | |
| 1,937,758 | A * | 12/1933 | Harris | 405/279 |
| 2,000,492 | A | 5/1935 | McKeen | |
| 2,018,423 | A | 10/1935 | Smith | |
| 2,189,804 | A * | 2/1940 | Knight | 405/279 |
| 3,638,435 | A | 2/1972 | Mason | |
| 4,012,883 | A | 3/1977 | Muller | |
| 4,329,089 | A | 5/1982 | Hilfiker et al. | |
| 4,343,572 | A | 8/1982 | Hilfiker | |
| 4,561,804 | A | 12/1985 | Weatherby | |
| 4,661,023 | A | 4/1987 | Hilfiker | |
| 4,917,543 | A * | 4/1990 | Cole et al. | 405/262 |
| 4,952,097 | A | 8/1990 | Kulchin | |
| 5,163,261 | A | 11/1992 | O'Neill | |
| 5,333,971 | A * | 8/1994 | Lewis | 405/281 |
| 5,368,414 | A | 11/1994 | Miller | |
| 5,386,675 | A | 2/1995 | Baur et al. | |
| 5,417,523 | A | 5/1995 | Scales | |
| 5,447,393 | A | 9/1995 | Yeates et al. | |
| 5,788,420 | A | 8/1998 | Scales | |
| 5,902,074 | A * | 5/1999 | Berkley et al. | 405/274 |
| 5,911,539 | A | 6/1999 | Egan et al. | |

(Continued)

FOREIGN PATENT DOCUMENTS

| | | |
|---|---|---|
| GB | 2.314.575 | 1/1998 |

(Continued)

OTHER PUBLICATIONS www.materialsintl.com/installation/process.htm(2pgs. dated Feb. 19, 2004).

(Continued)

*Primary Examiner*—Frederick L. Lagman
(74) *Attorney, Agent, or Firm*—Michael I Kroll

(57) ABSTRACT

The present invention relates to a corrugated asymmetrical sheet pile panel. The sheet pile panel is an asymmetrical about the Y-axis. The central section has a channel disposed therein for receiving a stiffening strip. The central section has two extensions, one joined to each side of the central section. Secured to each extension is a leg. The legs extend outward and away from the extensions. On the terminal end of each leg is a connector, where one leg has male connector and the other leg has a female connector. The width of the leg with the female connector is smaller than the width of the leg with the male connector. The difference is the two leg widths create a panel that is asymmetrical about the Y-axis and that is weight balanced about the Y-axis.

26 Claims, 15 Drawing Sheets

U.S. PATENT DOCUMENTS

| | | | | |
|---|---|---|---|---|
| 5,938,375 | A | 8/1999 | Wheeler, Jr. et al. | |
| 6,000,883 | A | 12/1999 | Irvine et al. | |
| 6,019,550 | A | 2/2000 | Wrigley et al. | |
| 6,033,155 | A * | 3/2000 | Irvine et al. | 405/281 |
| 6,168,351 | B1 | 1/2001 | Rainey | |
| 6,299,386 | B1 | 10/2001 | Byrne et al. | |
| 6,352,230 | B2 | 3/2002 | Grossman | |
| 6,443,664 | B1 * | 9/2002 | Horan et al. | 405/279 |
| 6,575,667 | B1 * | 6/2003 | Burt et al. | 405/287 |
| 6,709,201 | B2 | 3/2004 | Race | |
| 6,715,964 | B2 * | 4/2004 | Nottingham | 405/278 |
| 6,908,258 | B2 | 6/2005 | Timmerman | |
| 7,025,539 | B2 * | 4/2006 | Irvine | 405/274 |

FOREIGN PATENT DOCUMENTS

| | | | |
|---|---|---|---|
| JP | 62153414 A | * | 7/1987 |
| JP | 03025117 A | * | 2/1991 |
| WO | WO9927191 | | 6/1999 |

OTHER PUBLICATIONS www.cmilc.com/engineering/vinylpages/installationprint.htm(1pg.dated May 4, 2005).
Profile (1pg. dated Jun. 13, 2006).
The Northstar System—brochure (6 pages).
WaterFront Sheet Piling- brochure (2 pages).
C-Loc Engineered Vinyl Sheet Piling—brochure (2 pages).
SeasafeKorLock FRP Composite Sheet Pile—brochure (4 pages).
Shore Guard Vinyl Seawalls—brochure (3 pages).
Shore Guard Sheet Piling—brochure (2 pages).
Skyline CZ/CL/CS—brochure (2 pages).

* cited by examiner

CORRUGATED ASYMMETRICAL RETAINING WALL PANEL

BACKGROUND OF THE INVENTION

1. Field of the Invention

The present invention relates generally to retaining walls and, more specifically, to an elongated panel for constructing a corrugated sheet paneling retaining wall having extending male and female connector channels local to its sides and extending its length that interlock in an asymmetrical plurality to form said retaining wall having an additional channel extending vertically and central to each individual panel whereby an optional stiffening strip may be inserted having an optional reflective element utilized for the strengthening and enhanced visibility of a final retaining wall structure.

2. Description of the Prior Art

There are other sea wall retaining panels device designed for similar purpose. Typical of these is U.S. Pat. No. 5,447,393 issued to Yeates et al. on Sep. 5, 1995. Another patent was issued to Irvine et al. on Mar. 7, 2000 as U.S. Pat. No. 6,033,155 and another U.S. Pat. No. 6,575,667 was issued to Burt et al. on Jun. 10, 2003.

U.S. Pat. No. 5,447,393

Inventor: John A. Yeates et al.

Issued: Sep. 5, 1995

A wide sheet pile for the formation of buildings folded or formed from a metal plate or plates or by joining modular panels. The sheet pile is of corrugated form having upper and lower webs and joined by an inclined flange and provided on opposite sides with joining members and to enable the sheet pile to be connected to adjacent sheet piles. The sheet pile may incorporate a lateral stiffener or stiffeners. There is also disclosed pile driving apparatus for driving a sheet pile member into the ground, said apparatus including a pile driving frame for supporting drive means for applying a driving force to a said sheet pile member and means for coupling said pile driving frame to an adjacent said sheet pile member in the ground.

U.S. Pat. No. 6,033,355

Inventor: John E, Irvine et al.

Issued: Mar. 7, 2000

Structural panels (12) of extruded PVC and of stretched Z-shaped configuration and which can be driven into the ground include strengthening ribs (36-40) extending from the inner surfaces (34 and 35) of the opposed side sections (26 and 27). The ribs extend at a right angle to the side section bending planes (56 and 57) and at a right angle to the panel bending plane (64), thereby adding significant resistance to both compression and tension forces applied to the panel. The structural panels are driven into the earth to form a wall barrier, with the female locking element (43) being telescopically moved along the male locking element (42) of a previously installed panel. Distal strengthening rib (40) functions as a driving tongue to stabilize the position of the male locking element (42) during driving of the panel into the ground.

U.S. Pat. No. 6,575,667

Inventor: Kevin T. Burt et al.

Issued: Jun. 10, 2003

The present invention is directed to a retaining panel of one-piece construction for a body of water. A preferred embodiment of the retaining panel comprises a central portion, two side portions, and two flanges. The central portion has a first end and a second end. One side portion is integrally connected to and extends at a first angle from the first end of the central portion. Similarly, the other side portion is integrally connected to and extends at a second angle from the second end of the central portion. It is preferred that the first angle and the second angle are approximately equal. It is further preferred that the lengths of the first and second side portions are approximately equal. One flange is integrally connected to and extends at a third angle from a rear end of one side portion, and the other flange is integrally connected to and extends at a fourth angle from a rear end of the other side portion. It is preferred that the third and fourth angles are approximately equal. Each of the flanges has a proximal portion and a distal portion. The distal portion of one of the flanges defines a female connecting portion, and the distal portion of the other flange defines a male connecting portion. The retaining panel is preferably adapted to be interlocked with a substantially similar, adjacent retaining panel by inserting its male connecting portion into the female connecting portion of the adjacent retaining panel.

While these panels may be suitable for the purposes for which they were designed, they would not be as suitable for the purposes of the present invention, as hereinafter described.

SUMMARY OF THE PRESENT INVENTION

The present invention provides for a weight distributed panel about the Y-axis by shortening the female arm portion relative to the male arm portion resulting in an asymmetrical weight distributed panel that aids in the proper alignment and installation of the panel. The panels of the present invention are used as a pile and driven into the earth. The panels can be used as but not limited to retaining or barrier walls such as sea walls, piers, dikes, and the like.

To stiffen the central section of the panel, the present invention provides for a corrugated longitudinal channel in the preferred embodiment as opposed to ribbing which would also stiffen the panel but the channel also provides for additional elements that would enhance the functionality of the panel.

A stiffening strip can be inserted into the channel adding to the structural integrity of the panel and when applicable the stiffening strip exterior surface can be treated with a reflective coating or colorized for an intended purpose.

As an example, in the construction of a sea wall, established maritime indicators of color or pattern can be applied to the fascia of the stiffening strip or application of the aforementioned reflective coating. The present invention also provides that the surface of the stiffening strip, especially when used in sea wall construction, does not extend beyond the planar surface of the flat panel portion thereby enabling the attachment of wale beams thereto. In regards to retaining wall construction this limitation need not apply and may extend beyond the flat panel surface in some unforeseen decorative or aesthetic purpose in addition to stiffening the panel.

A primary object of the present invention is to provide a retaining wall panel having corrugations placed within the exterior wall.

Another object of the present invention is to provide a retaining wall panel that is asymmetrical about the Y-axis.

Yet another object of the present invention is to provide a retaining wall panel wherein the corrugation includes a centrally disposed longitudinal channel having opposing nub-like rails.

Still yet another object of the present invention is to provide a longitudinal stiffening member insertable into the channel and retained therein by said nub-like rails.

Another object of the present invention is to provide said stiffening member with a face that mounts flush with the panel surface that the channel is disposed in order to allow for a flush mounting of a wale beam or other structural member.

Yet another object of the present invention is to provide said stiffening member of a particular color having a predesignated meaning within the maritime industry.

Still yet another object of the present invention is to provide said stiffening member with a coating of a particular pattern having a predesignated meaning within the maritime industry.

Another object of the present invention is to provide a retaining wall panel having male and female connectors that interlock, panel to panel.

Additional objects of the present invention will appear as the description proceeds.

The present invention overcomes the shortcomings of the prior art by providing corrugated sheet piling retaining wall panels having male and female connectors on opposing sides that interlock, panel to panel with each panel asymmetric about the Y-axis. The corrugation forming a centrally disposed longitudinal channel wherein a stiffening member can be inserted and retained therein and optionally incorporating an exterior colorized surface or pattern of a predetermined maritime designation.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

LIST OF REFERENCE NUMERALS

Figure 1:
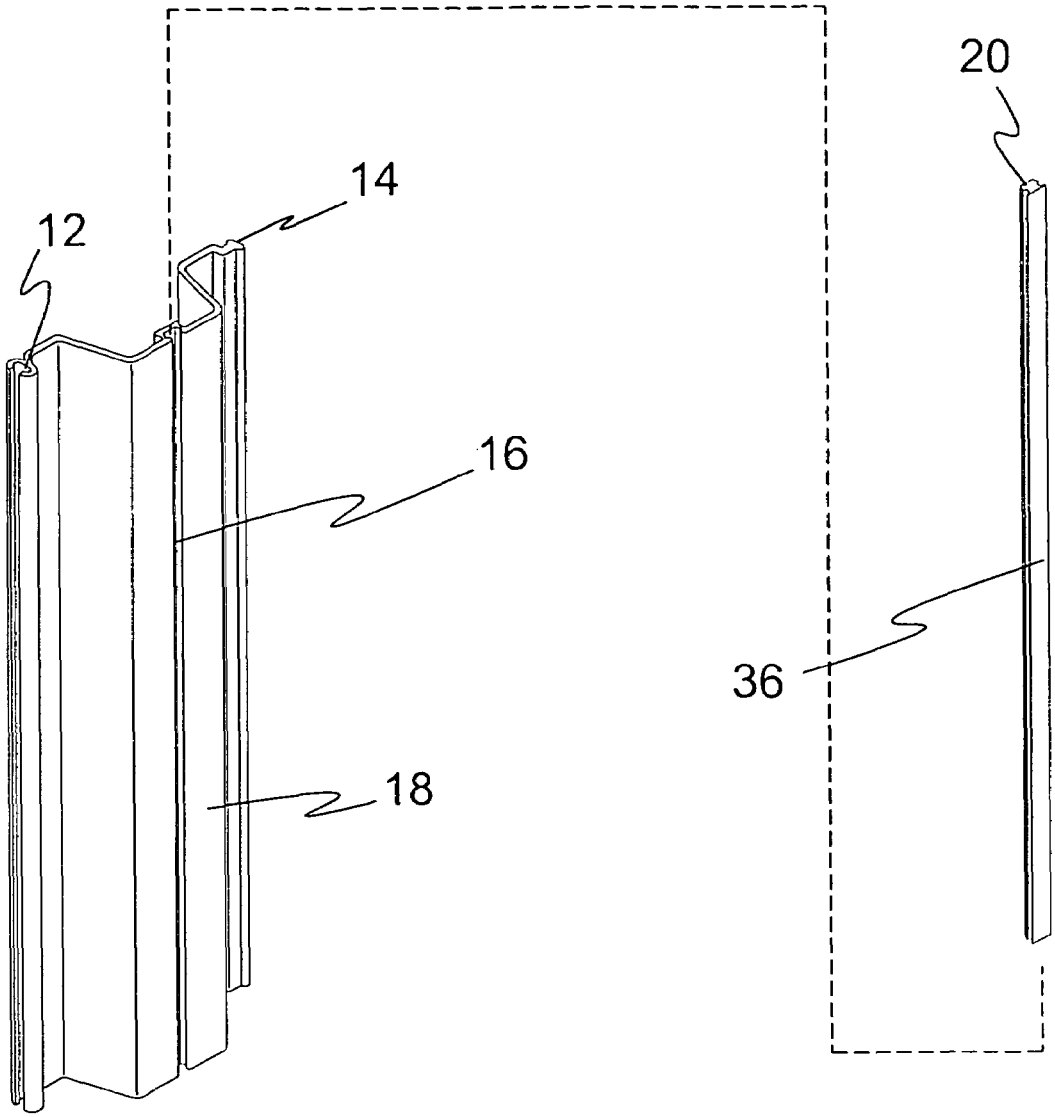
FIG. 1 is an illustrative view of the present invention.

With regard to reference numerals used, the following numbering is used throughout the drawings.

10 Present Invention
12 Female Connector
14 Male Connector
16 Stiffening Channel
18 Central Section
20 Stiffening Strip
22 Y-axis
24 Male Leg
26 Female Leg
28 Horizontal Plane
30 Acute Angle
32 Obtuse Angle
34 Rails
36 Reflective Material
38 Extension

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 2:
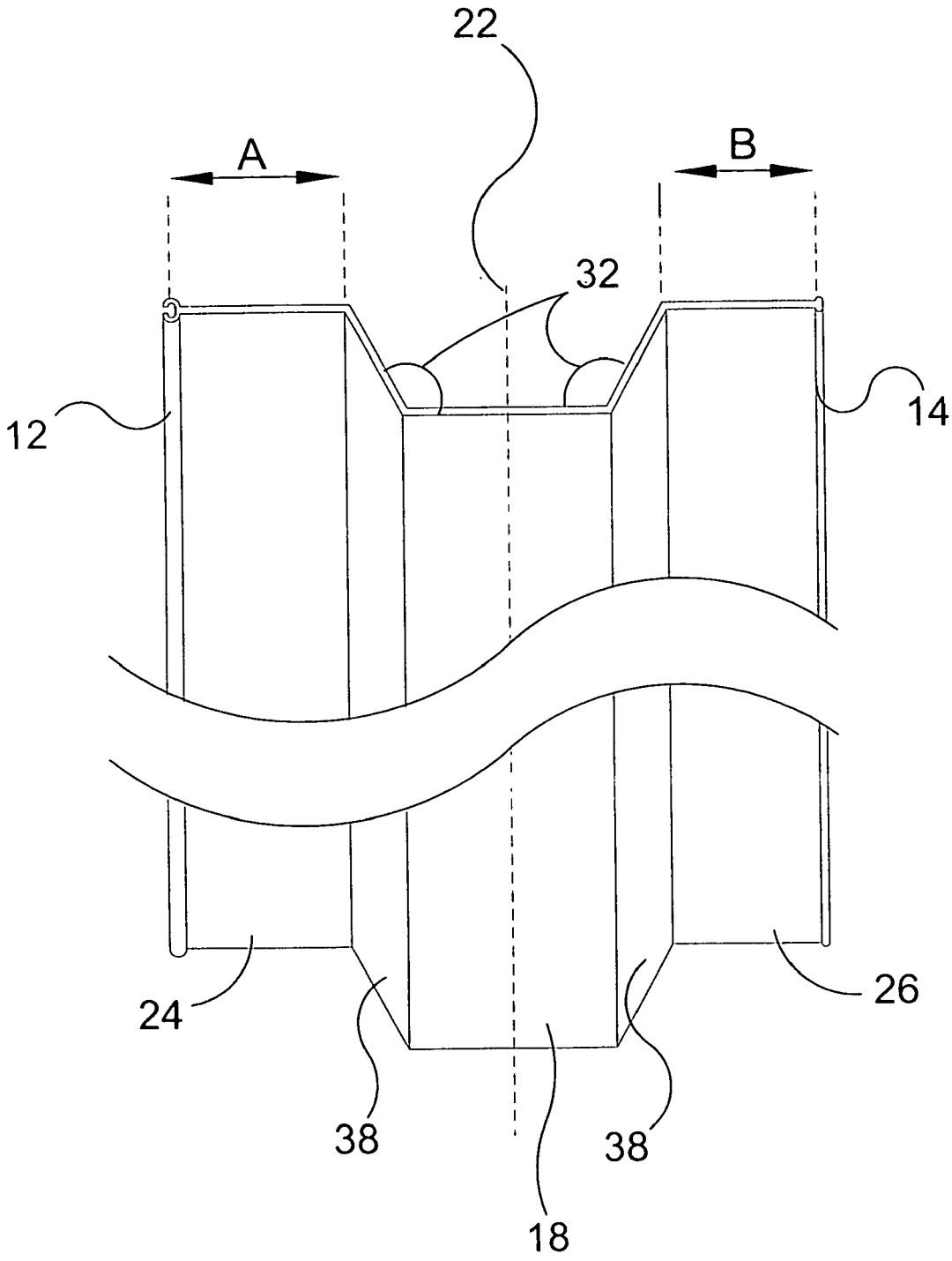
FIG. 2 is a perspective view of an asymmetrical panel of the present invention.
Figure 2A:
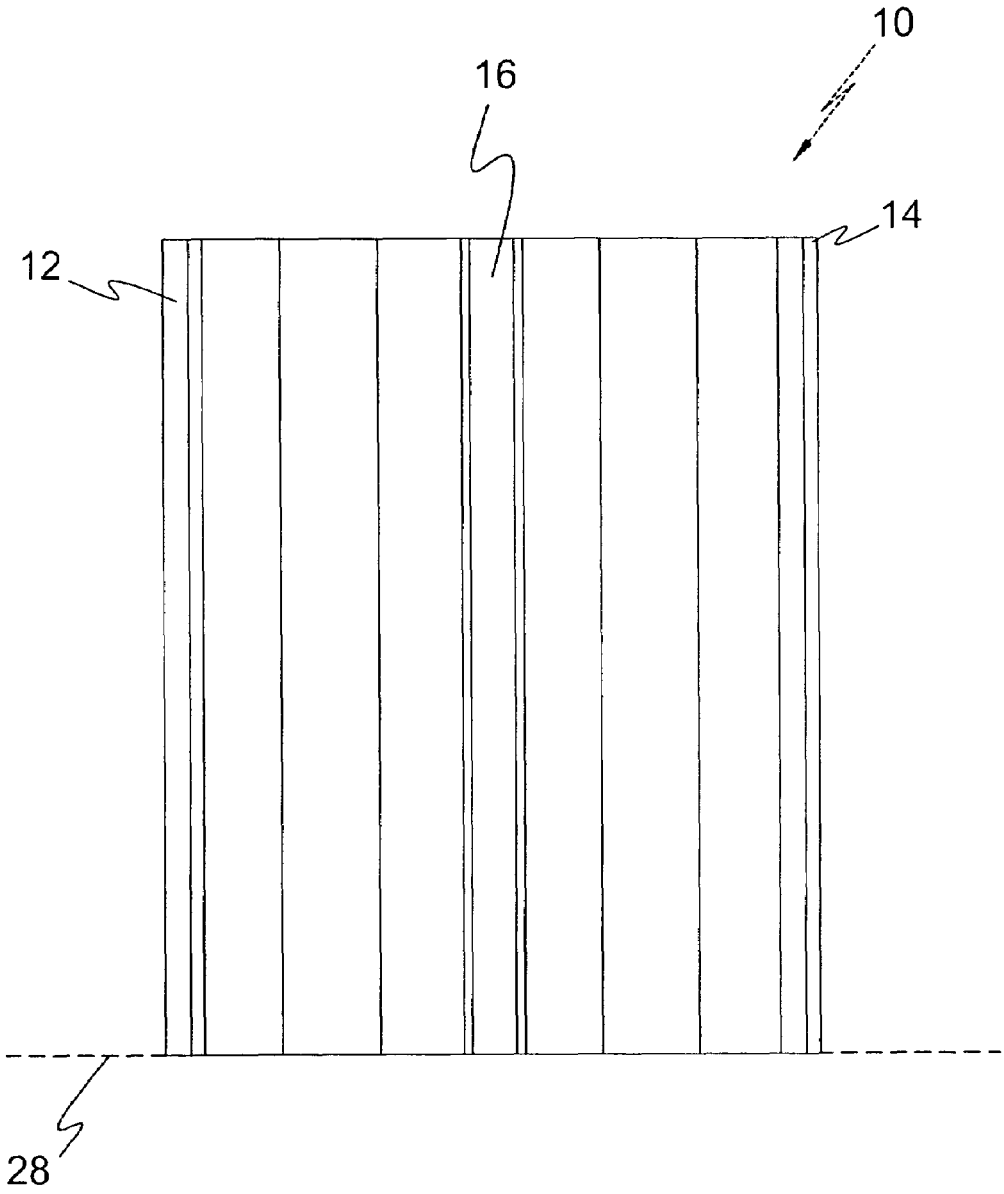
FIG. 2A is a front view of a suspended asymmetrical panel of the present invention.
Figure 2B:
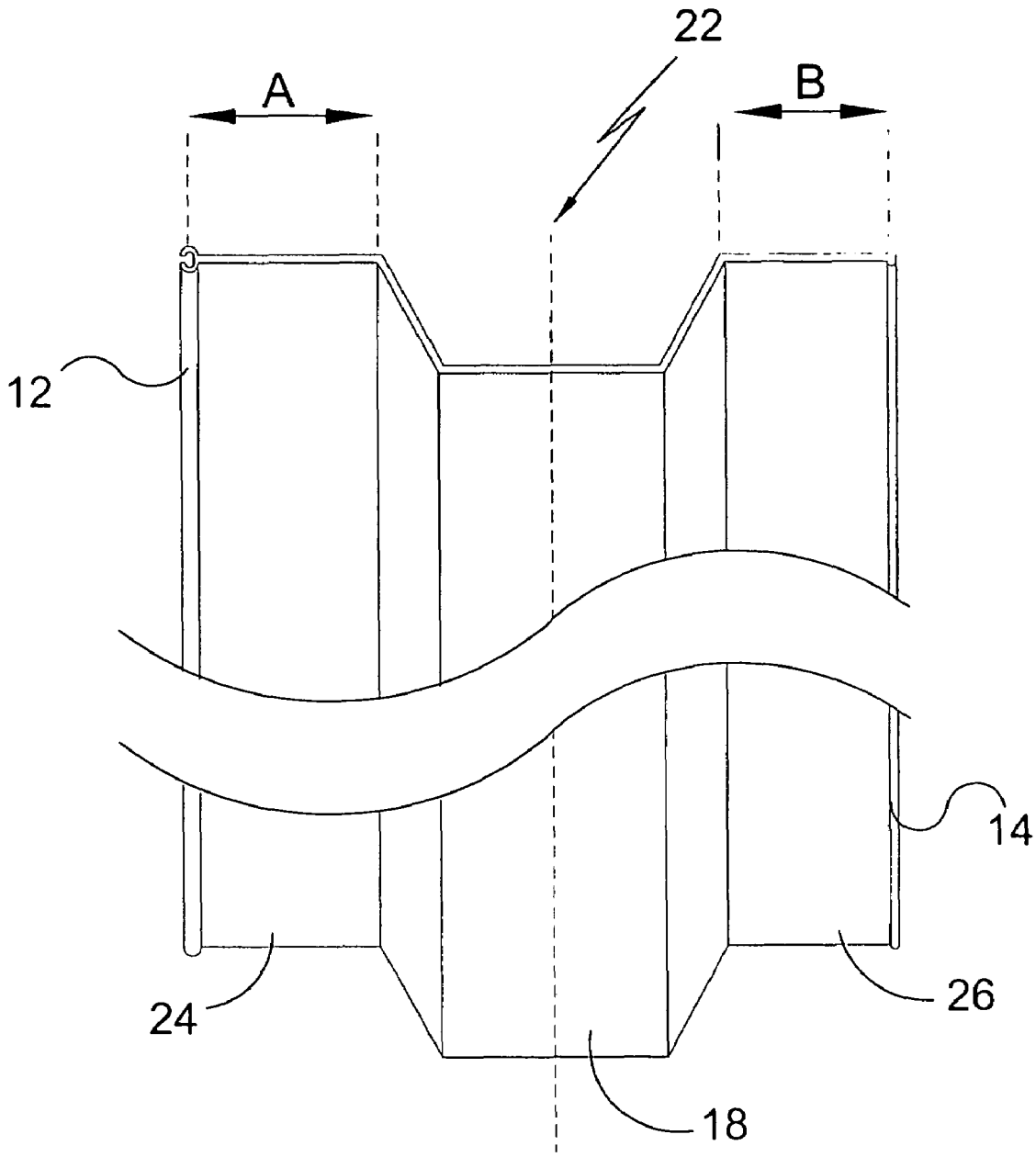
FIG. 2B (PRIOR ART)
FIG. 2B is a perspective view of a prior art symmetrical panel.
Figure 2C:
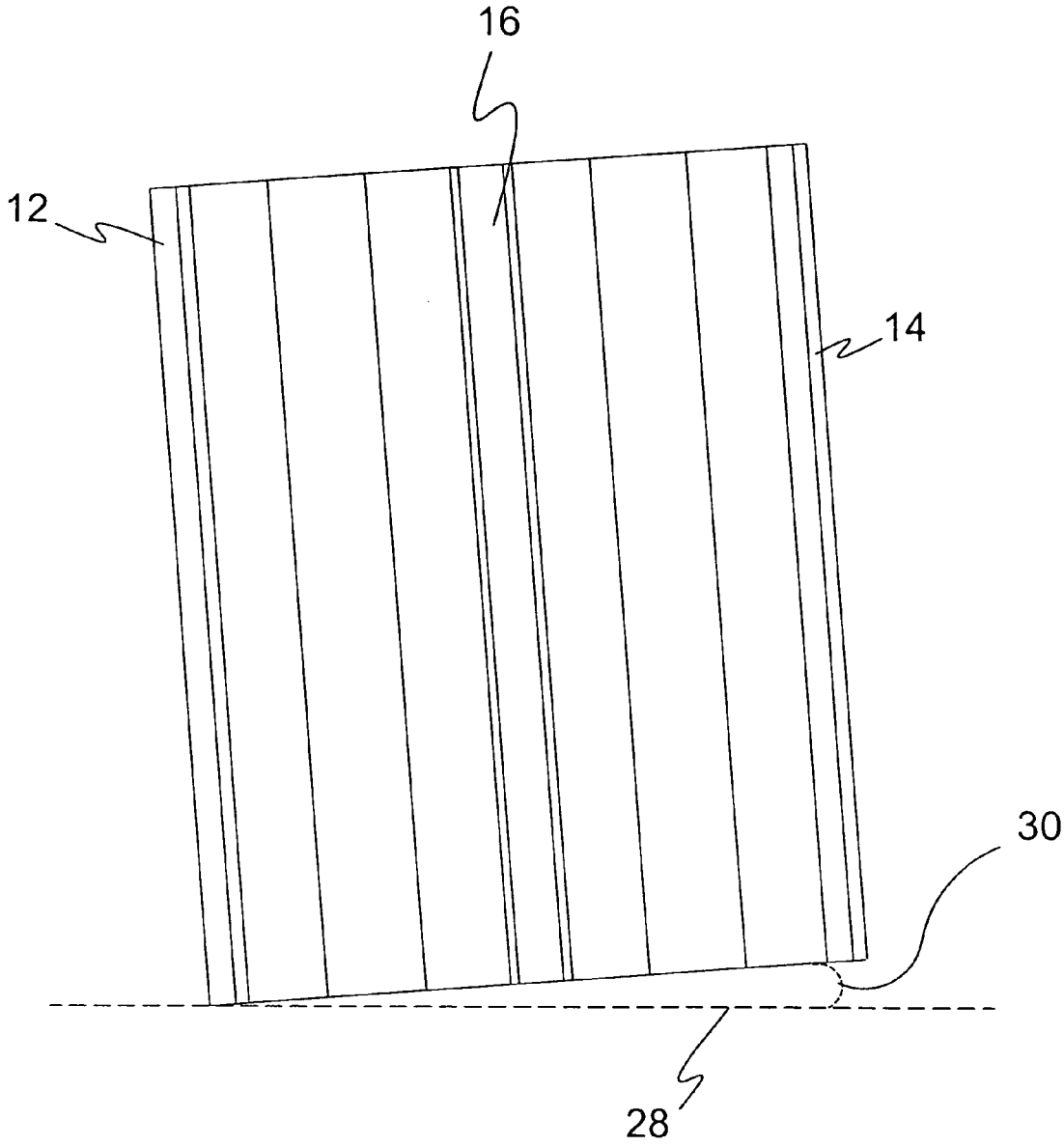
FIG. 2C (PRIOR ART)
FIG. 2C is a front view of a suspended prior art symmetrical panel.
Figure 4:
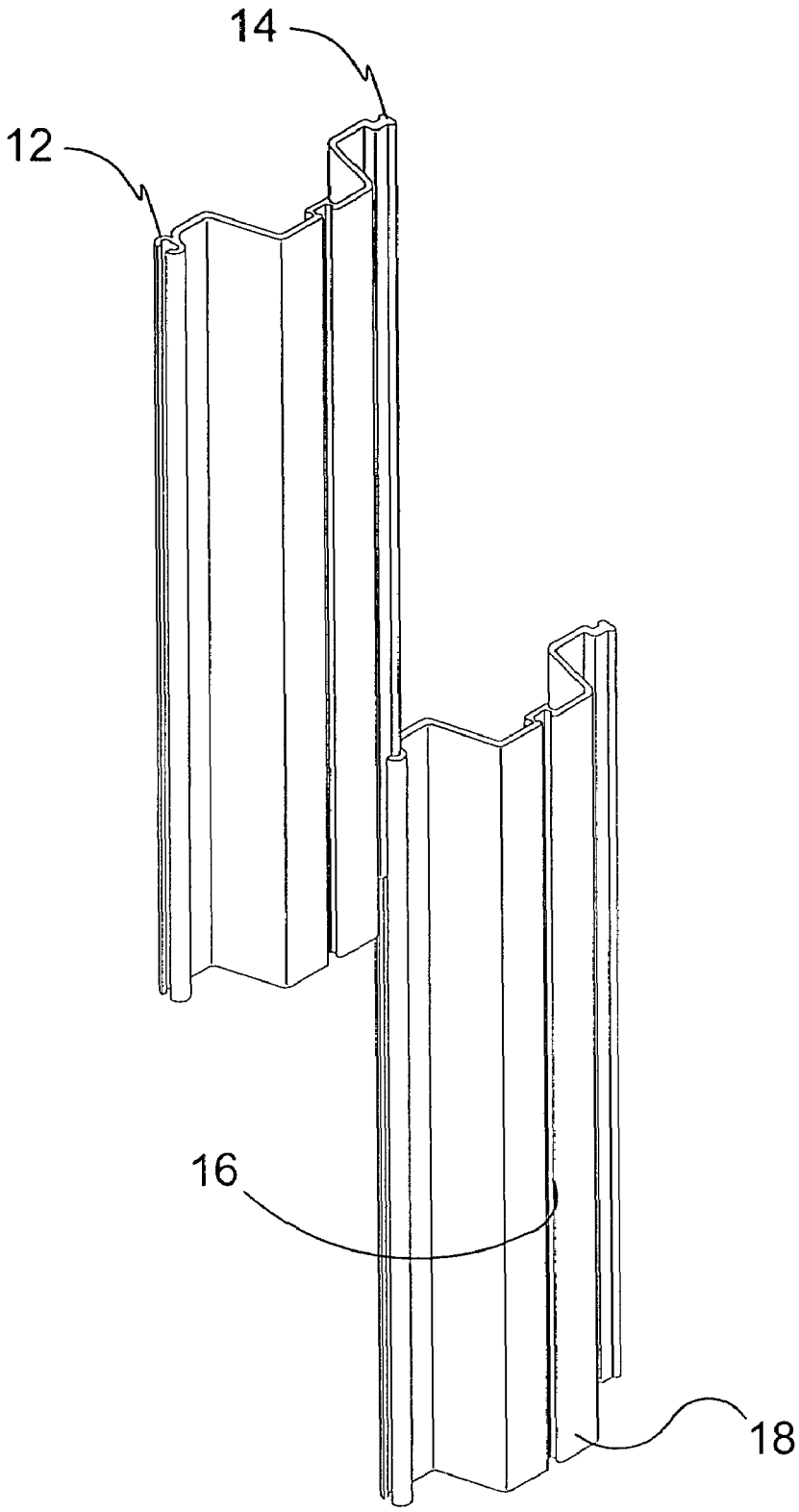
FIG. 4 is a perspective view of the present invention.
Figure 5:
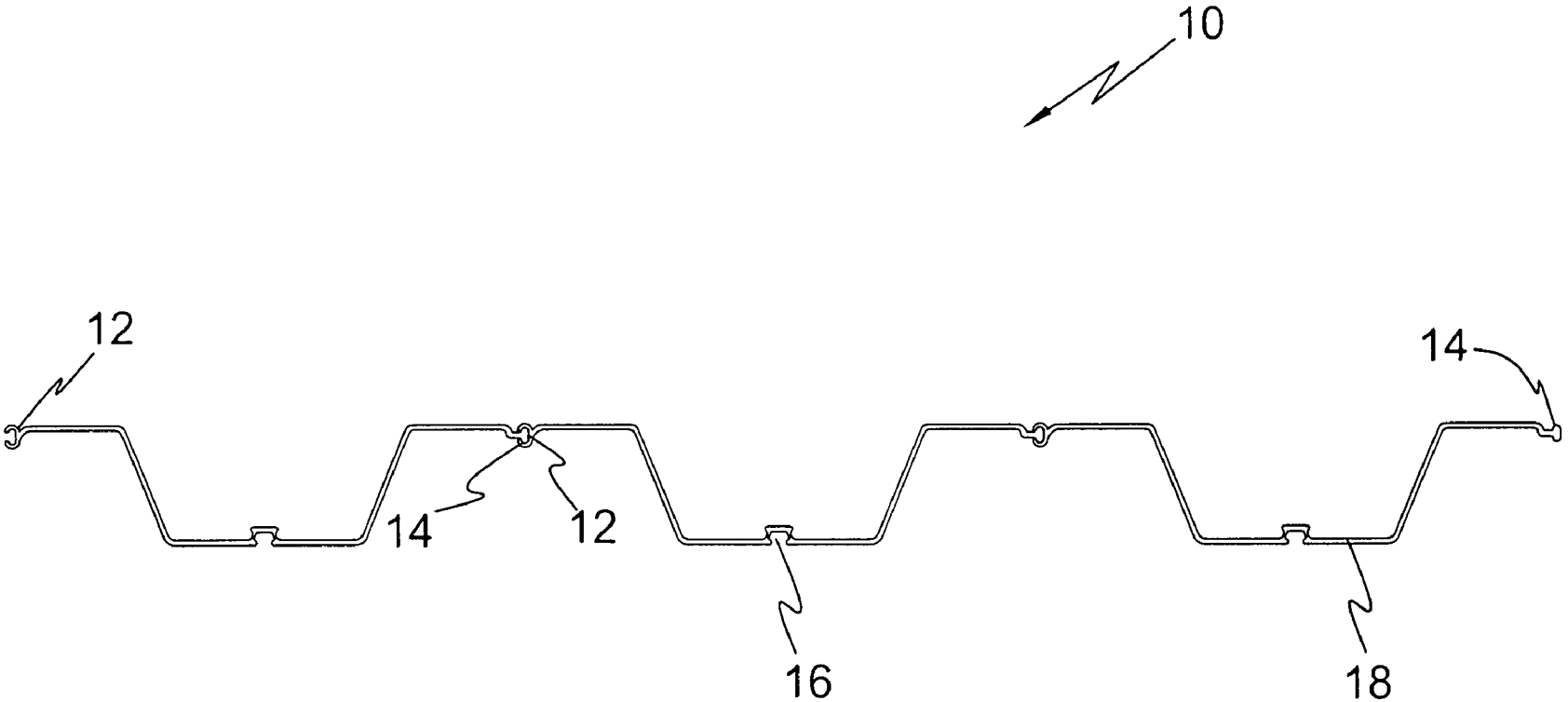
FIG. 5 is a top view of assembled panels of the present invention.
Figure 6:
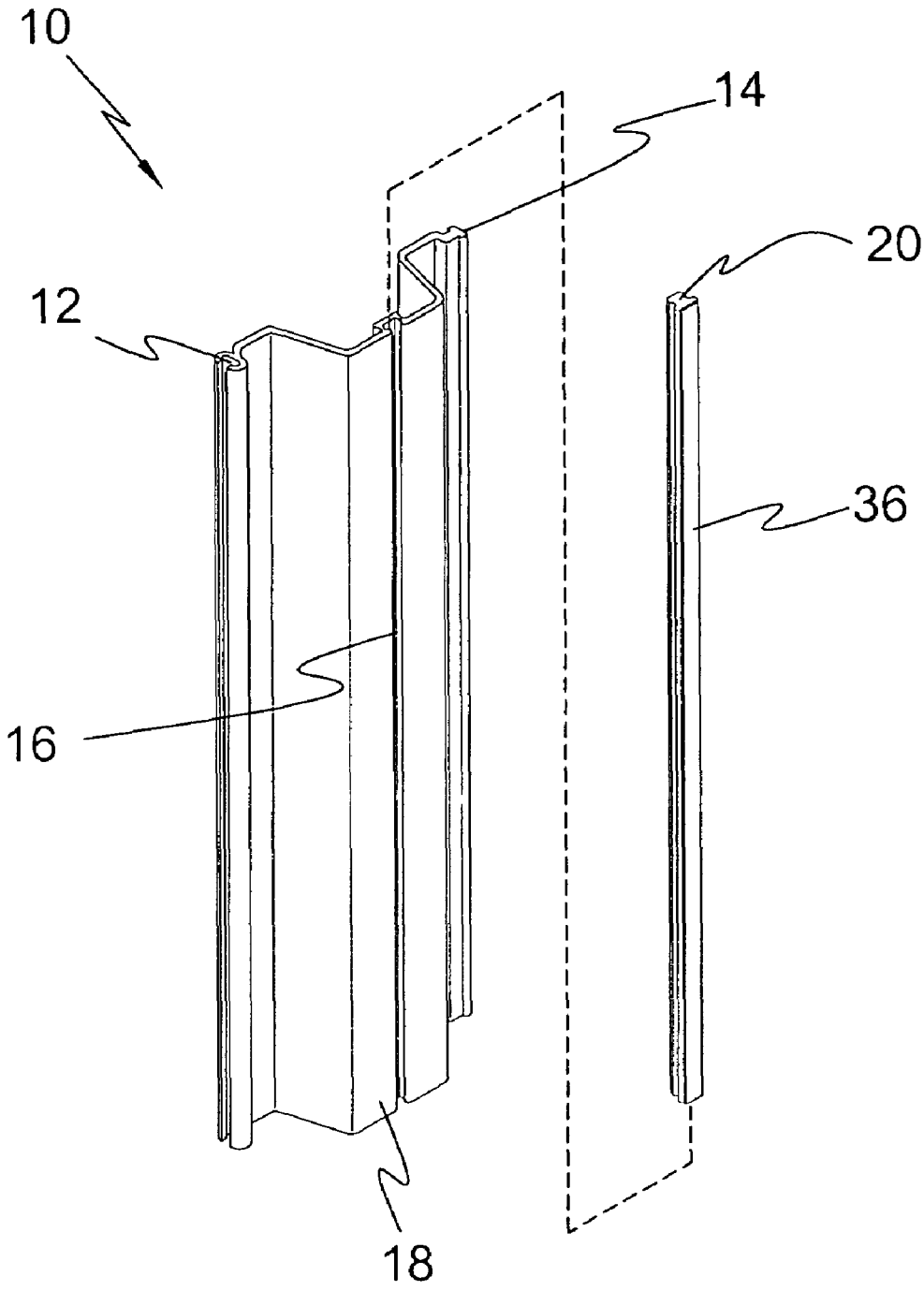
FIG. 6 is a perspective view of the present invention.
Figure 7:
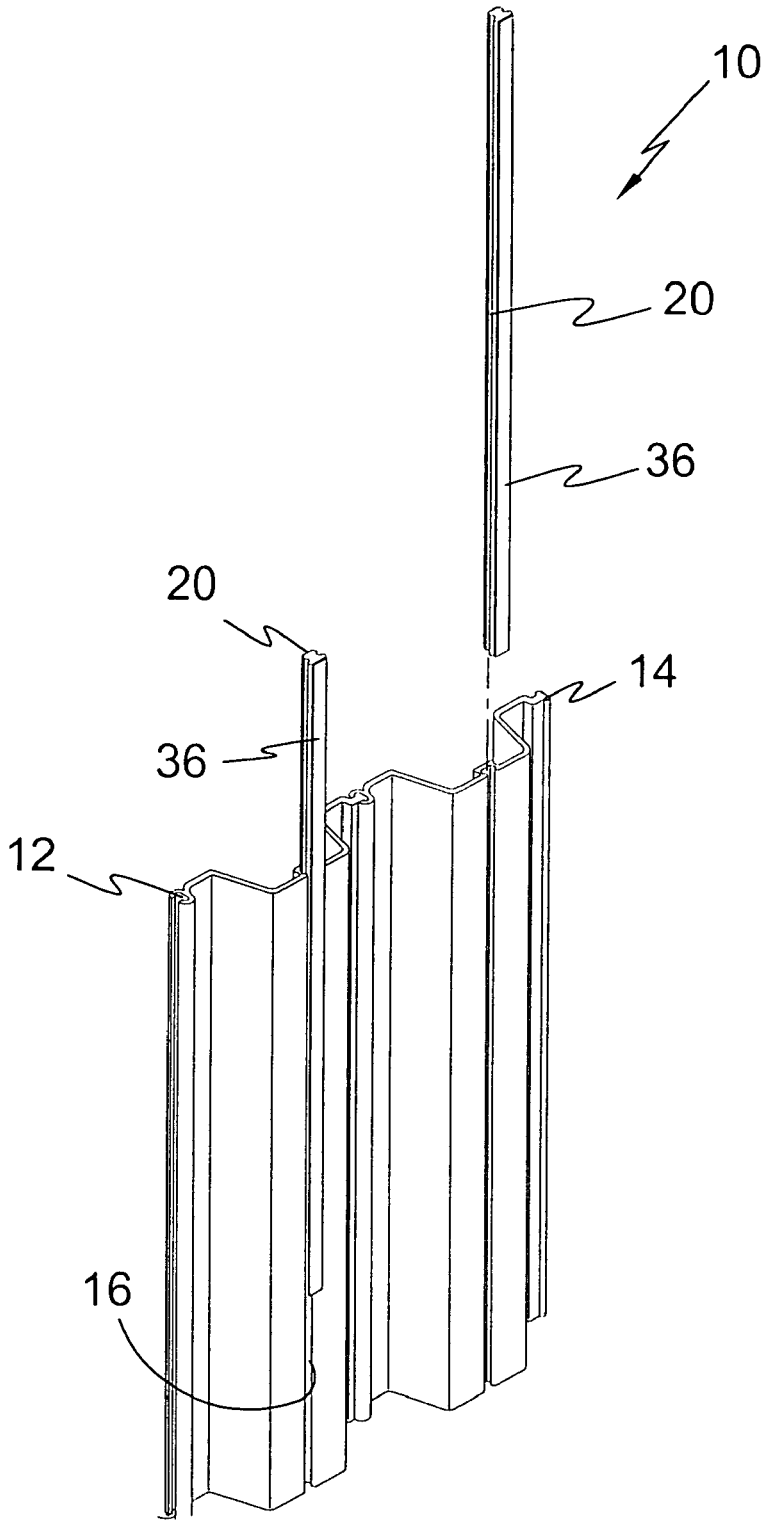
FIG. 7 is a perspective view of the present invention.

Looking at FIG. 1, the present invention 10 is shown. The present invention 10 is a corrugated asymmetrical sheet pile panel. The panel has a central section 18 with right and left extensions 38. Each extensions 38 projects away from the central section 18 at an obtuse angle 32 with respect to the inner surface of the central section 18. The right extension 38 has a male leg 24 secured thereon. The male leg 24 projects away from the right extension in a plane that is parallel to the plane of the central section 18. The male leg 24 terminates in a male connector 14. The left extension 38 has a female leg 26 secured thereon. The female leg projects away from the left extension in a plane that is parallel to the plane of the central section. The female leg 26 terminates in a female connector 12. These connectors facilitate joining of adjacent panels as seen in FIG. 4. A stiffening channel 16 is provided in the central section 18 for receiving a stiffening strip 20 to reinforce and stiffen the central section 18. The panel is asymmetrical about the Y-axis 22 as seen in FIG. 2. The female leg 26 has a length A, which is longer than the length B of the male leg 24. The increased length of the male leg 24 compensates for the greater amount of material used in the female connector 12. Thus the panel is weight balanced about the Y-axis 22, i.e. the panel has the same amount of weight to the right of the Y-axis 22 as to the left of the Y-axis 22. When an asymmetrical panel is lifted and suspended for installation, the panel will hang vertically true along the Y-axis 22. If the bottom edge of a suspended asymmetrical panel is rested on an imaginary horizontal plane 28, the bottom edge of the sheet pile panel will be perfectly aligned with the horizontal plane 28 as seen in FIG. 2A. Unlike the prior art symmetrical panel of FIG. 2B, where the female leg 26 is the same length as the male leg 24. When the prior art symmetrical panel is suspended for installation, the panel will hang tilted to the female connector side 12. The tilt is due to the extra material of the female connector 12 which makes the side of the panel with the female connector 12 weigh more than the side of the panel with the male connector 14. If the bottom edge of the symmetrical panel is rested on an imaginary horizontal plane 28, the bottom edge of the symmetrical panel forms an acute angle 30 with the horizontal plane 28 as seen in FIG. 2C.

Figure 3:
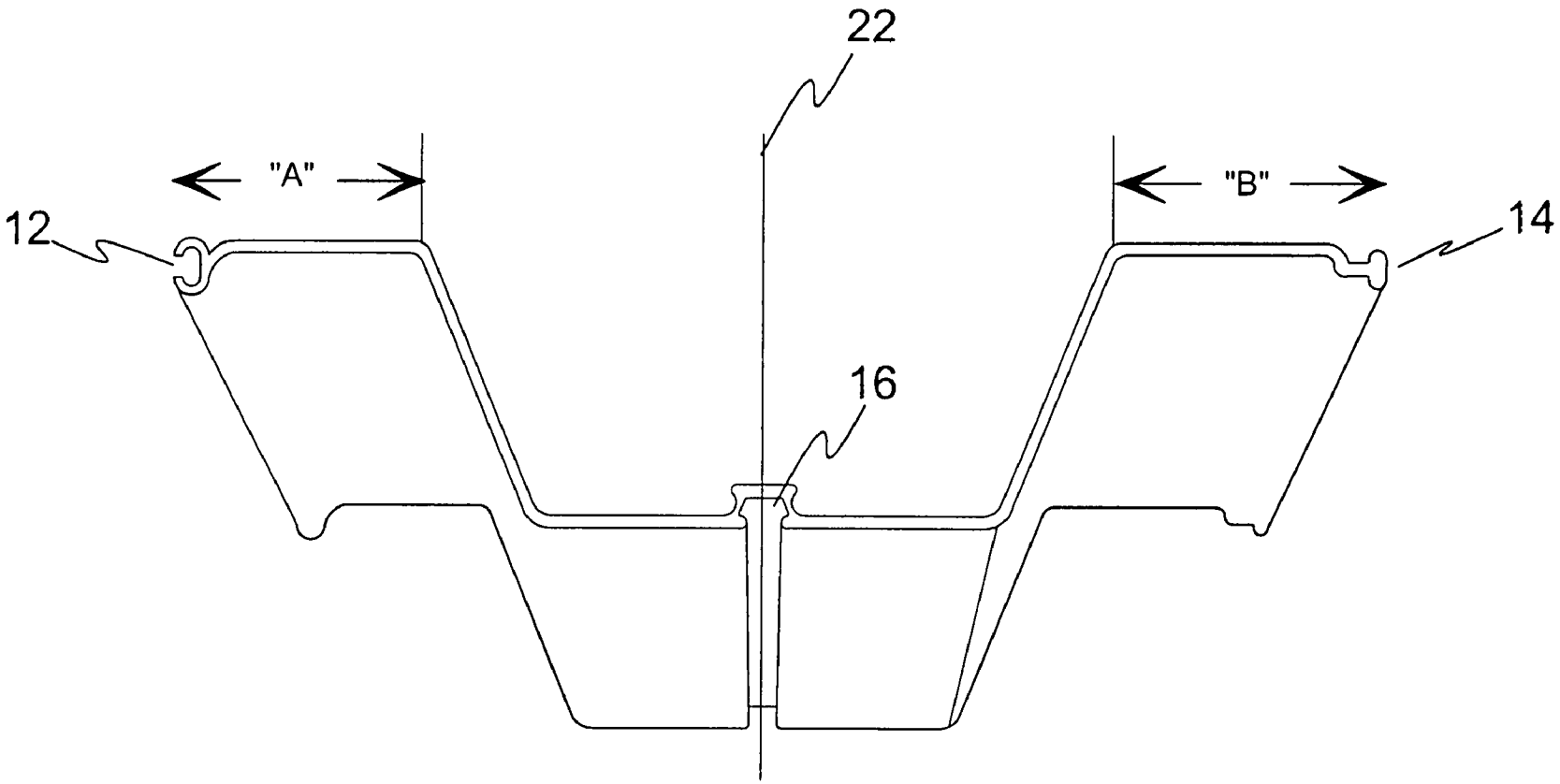
FIG. 3 is a top view of the present invention.
Figure 3A:
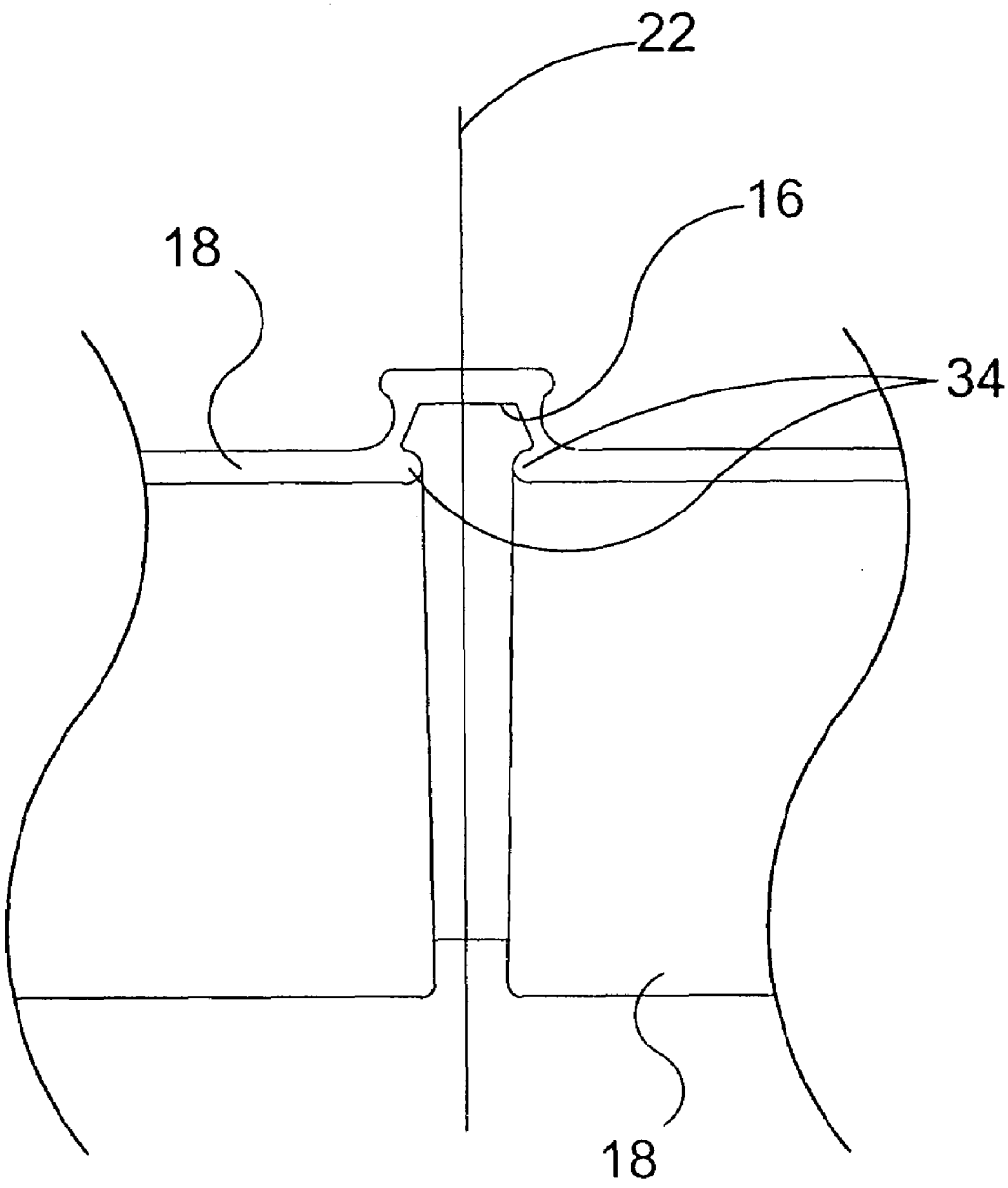
FIG. 3A is a enlarged view of the channel of the present invention.

Looking at FIG. 3, a top view of an asymmetrical sheet pile panel of the present invention 10 is shown. The stiffening channel 16 disposed in central section 18 is more clearly seen. This stiffening channel 16 provides two functions; it stiffens the central section 18 and allows for installation of a stiffening strip 20 for further stiffening of the panel. The stiffening channel 16 protrudes from the inner surface of the central section 18 making the inner surface of the central section 18 corrugated. The outer surface of the central section 18 is a planar surface disposed in a single pane. The outer surface is separated into right and left halves by the stiffening channel 16 disposed therein. The stiffening channel has opposing nub-like rails 34, which secure the stiffening strip in the channel 16. The nub-like rails narrow the opening of the channel in the outer surface of the central section. See FIG. 3A, where an enlarged view of the channel and the rails 34 are shown.

The stiffening strip 20, seen in FIGS. 1, 6-8, and 9, is a separate member which slides into the channel 16 in the central section 18 to further stiffen the asymmetrical sheet pile panel. The stiffening strip 20 can protrude beyond the outer surface of the central section 18 or the stiffening strip 20 can be flush with the outer surface of the central section 18. A flush stiffening strip 20 is useful in a sea wall application enabling the attachment of a wale beam (not shown) to the planar surface of the central section 18. The outer or exposed surface of the stiffening strip 20 may have a coating of a reflective material 36 disposed thereon. The outer surface of the stiffening strip 20 may have an established maritime indicator secured thereon. These indicators typically employ colors and or patterns to convey a message. The stiffening strip 20 can be made of the same material as that of the panel or a different material. Preferably the stiffening strip will be made of a material that is stiffer than the material of the panel. For example, a plastic panel may have either a plastic stiffening strip or a metal stiffening strip. It has also been contemplated that a metal stiffening strip 20 can be coated to resilient plastic to further secure the strip 20 in the channel 16.

Figure 8:
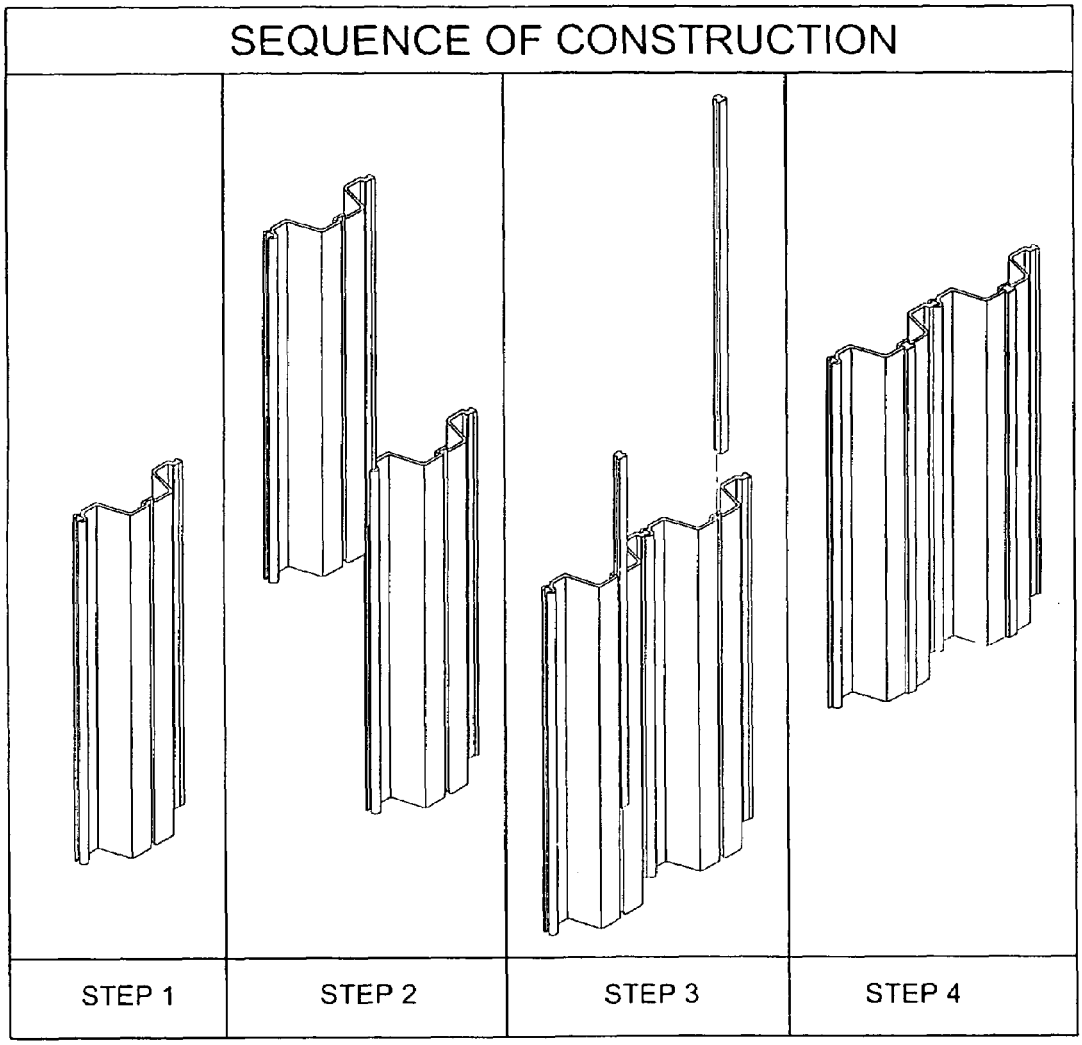
FIG. 8 is a sequence of construction chart of the present invention.

FIG. 4 shows how two asymmetrical sheet pile panels of the present invention are joined. Typically a panel is driven into a desired location. A second panel is suspended above the driven panel so that the two panels can be joined by their connectors. The male connector 14 of the second panel is installed in the female connector 12 of the driven panel. The suspended asymmetrical sheet pile panel hangs vertically true along the Y-axis making installation easier and preventing damage to either of the mating panels. The second panel is then driven into the position seen in FIG. 7. FIG. 8 shows one possible sequence of construction. In step one, the first panel is driven in the desired location. In step two, the male connector 14 of a second panel is joined to the female connector 12 of the first panel and then the second panel is driven into position. In step three, a stiffening strip 20 is installed into each of the driven panels. In step four the stiffening strip are pushed into the channels 16 so that the upper end of a strip is flush with the top edge of the panel in which it is disposed. In the alternative, the female connector 12 of second panel may be joined to the male connector 14 of the first panel. The stiffening strips 20 may be installed in the sheet pile panels before the panels are driven into the ground. This eliminates trying to fit a stiffening strip in a sheet that may have deformed slightly during the driving process.

Figure 9:
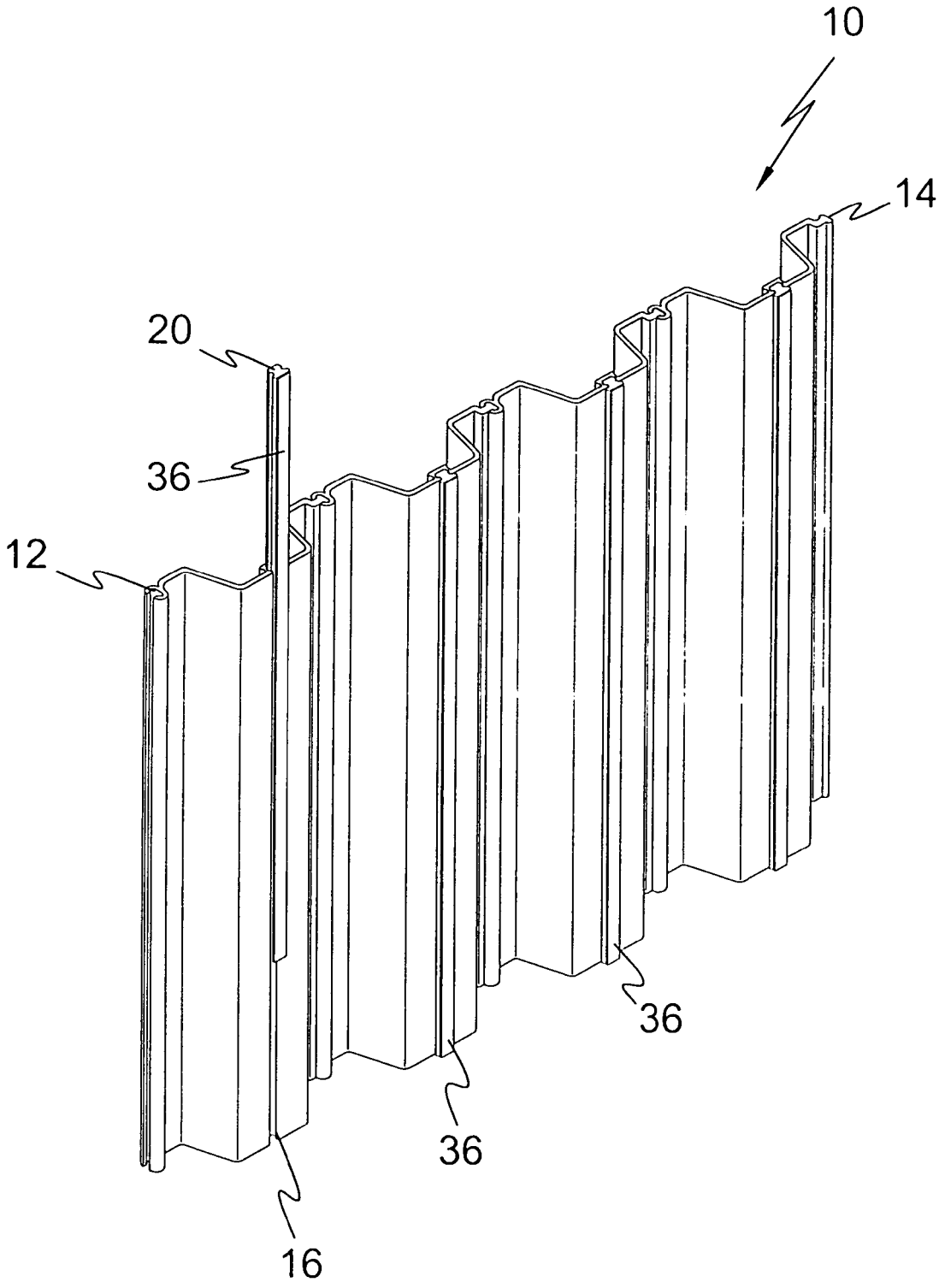
FIG. 9 is a perspective view of the present invention.
Figure 10:
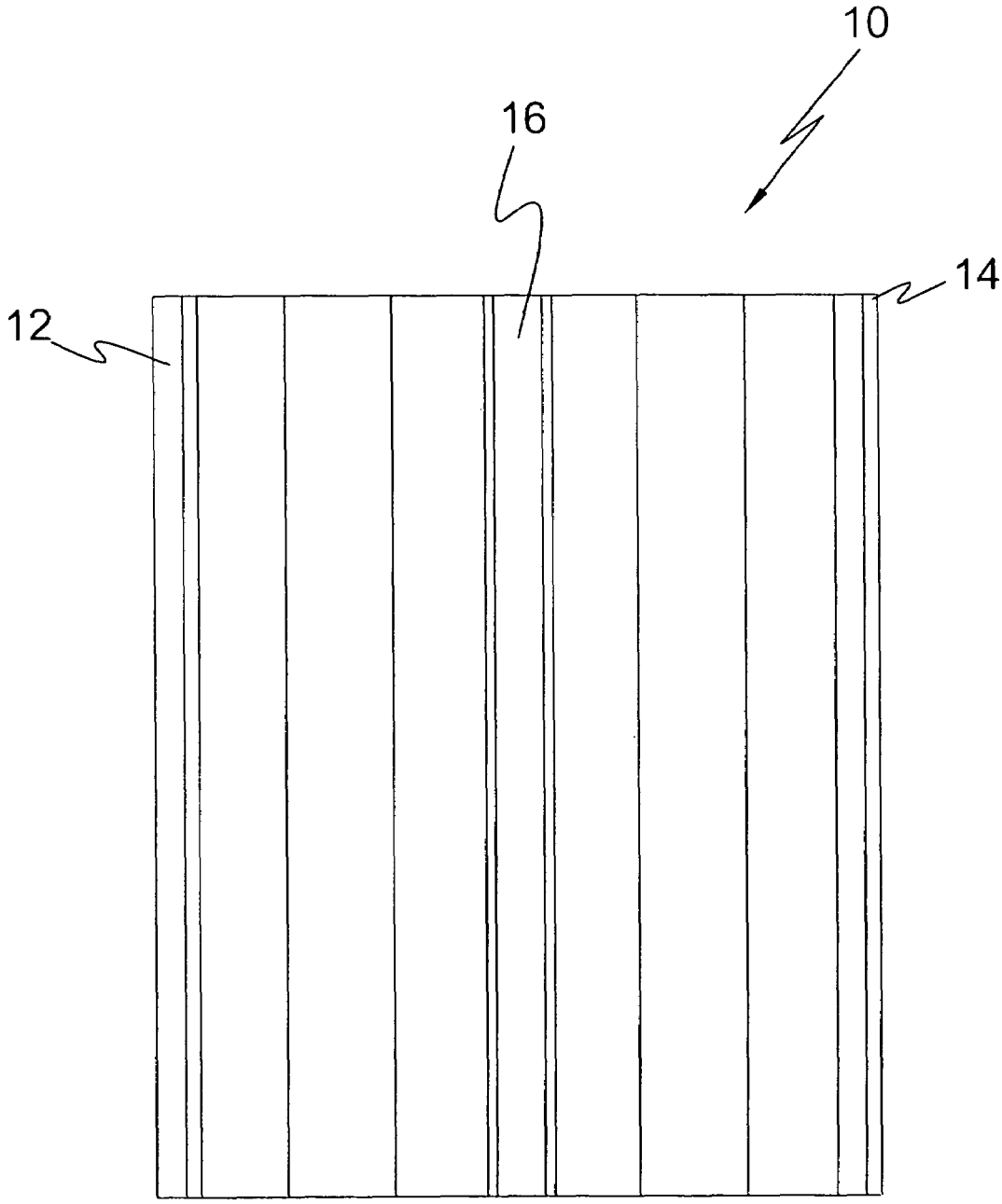
FIG. 10 is a front view of the present invention.
Figure 11:
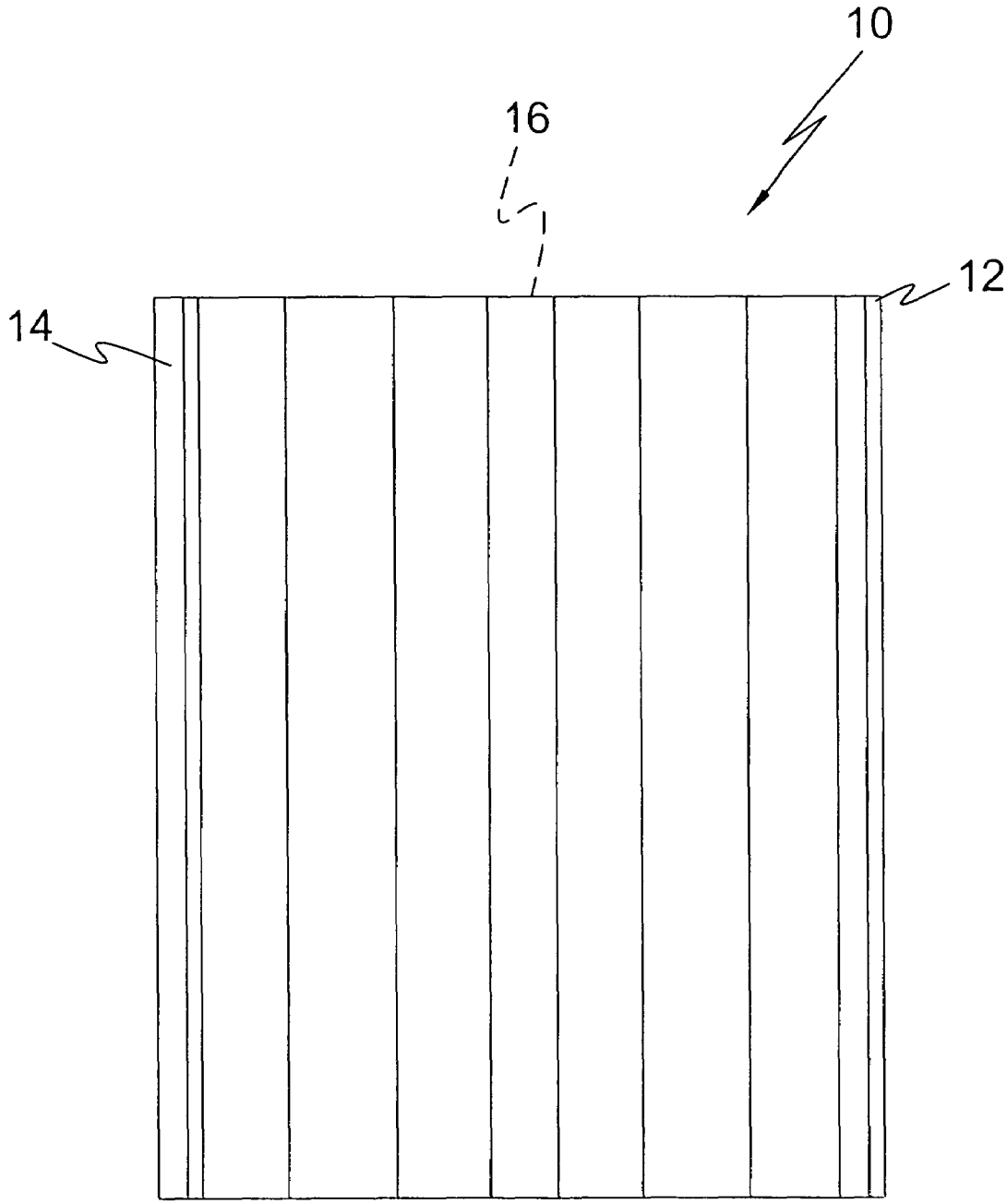
FIG. 11 is a back view of the present invention.

FIG. 9 shows four interconnected panels where each panel has a stiffening strip 20. Any number of panels may be joined together to satisfy the needs of the user. The stiffening strip 20 in one of the panels is shown in a partially installed state to further emphasize the strip 20. The strip has a narrowed portion in which the rails of the channel are received. FIGS. 10 and 11 show a front view and back view of an asymmetrical panel of the present invention 10 without a stiffening strip 20. The front view shows the open side of channel 16 and the back view shows the closed side of channel 16. The stiffening channel 16 has two open ends. One open end is at the top edge of the panel and the other is at the bottom edge of the panel. This provides the user with the option of installing a stiffening strip 20 from either end of the panel. It has been contemplated that the panels can be made from plastic such as polyvinylchloride (PVC). The panels may be formed of any other suitable plastic. The panels may also be formed of a fiber reinforced plastic. The fibers may include but are not limited to nylon, polyester, carbon, glass, or an aramid. Kevlar is the trade name of an aramid fiber made by Dupont. It has been contemplated that the panels can be formed from aluminum or steel or any other suitable metal. Steel panels may be galvanized to inhibit rust. Steel panels may be coated with paint to enhance their appearance or as a rust inhibitor. The paint coating may be used in combination with or in lieu of galvanizing.

I claim:

1. A corrugated sheet pile panel comprising:

a central section having an outer face and an inner face disposed opposite to the outer face, said inner face having a protrusion disposed thereon, said outer face having a slot disposed therein opposite the protrusion on the inner face forming a channel for receiving a stiffening strip, said outer surface being a planar surface disposed in a single plane, said central section having right and left sides, wherein each of said sides has an extension formed thereon, wherein each extension extends away from the central section such that an obtuse angle is formed with respect to the inner surface of the central section and each of the extensions, wherein the extensions extend away from the inner surface of the central panel a greater distance than a distance the protrusion protrudes from the inner surface of the central section, wherein a right of said extensions has a right leg formed thereon which extends outwardly away from said right extension in a plane parallel to said central section, said right leg having a right terminal end, said right terminal end having a male connector formed thereon, wherein a left of said extensions has a left leg formed thereon which extends outwardly away from said left extension in a plane which is parallel to said central section, wherein said left leg has a left terminal end, said left terminal end having a female connector formed thereon, wherein the left leg has a length between said female connector and said left extension, and the right leg has a length between the male connector and said right extension, wherein the length of said left leg is shorter than the length of said right leg, such that the panel is asymmetrical about a Y-axis, wherein the Y-axis is parallel with the slot in the central section and is disposed vertically in the horizontal center of the axis, wherein the panel has an even weight distribution about said Y-axis.

2. The sheet pile panel of claim 1, wherein the panel has a stiffening strip disposed in said slot.

3. The sheet pile panel of claim 2, wherein the stiffening strip has an outer surface, which is flush with the outer surface of said central section.

4. The sheet pile panel of claim 2, wherein the stiffening strip has an outer surface, which protrudes beyond the outer surface of the central section.

5. The sheet pile panel of claim 3, wherein the outer surface of the stiffening strip has a reflective surface disposed thereon.

6. The sheet pile panel of claim 4, wherein the outer surface of the stiffening strip has a reflective surface disposed thereon.

7. The sheet pile panel of claim 5, wherein the sheet pile panel is made of plastic and the stiffening strip is made of metal.

8. The sheet pile panel of claim 6, wherein the sheet pile panel is made of plastic and the stiffening strip is made of metal.

9. The sheet pile panel of claim 5, wherein the sheet pile panel and the stiffening strip are both made of metal.

10. The sheet pile panel of claim 6, wherein the sheet pile panel and the stiffening strip are both made of metal.

11. The sheet pile panel of claim 5, wherein the sheet pile panel and the stiffening strip are both made of plastic.

12. The sheet pile panel of claim 6, wherein the sheet pile panel and the stiffening strip are both made of plastic.

13. The sheet pile panel of claim 8, wherein the outer surface of stiffening strip is wider than the width of the slot.

14. A corrugated sheet pile panel comprising:

a central section having an vertical channel formed therein for receiving a stiffening strip, said central section having inner and outer surfaces, said outer surface being a planar surface disposed in a single plane, said central section having right and left sides, wherein each of said sides has an extension formed thereon, wherein each extension extends away from the central section at an obtuse angle, wherein the extensions extend away from the inner surface of the central panel a greater distance than the distance the protrusion protrudes from the inner surface of the central section, wherein a right of said extensions has a right leg formed thereon which extends outwardly away from said right extension in a plane parallel to said central section, said right leg having a right terminal end, said right terminal end having a male connector formed thereon, wherein a left of said extensions has a left leg formed thereon which extends outwardly away from said left extension in a plane which is parallel to said central section, wherein said left leg has a left terminal end, said left terminal end having a female connector formed thereon, wherein the left leg has a length between said female connector and said left extension, and the right leg has a length between the male connector and said right extension, wherein the length of said left leg is shorter than the length of said right leg, such that the panel is asymmetrical about a Y-axis, wherein the Y-axis is parallel with the slot in the central section and is disposed vertically in the horizontal center of the axis, wherein the panel has an even weight distribution about said Y-axis, wherein said channel has at least one open end for receiving a stiffening strip.

15. The sheet pile panel of claim 14, wherein the panel has a stiffening strip disposed in said slot.

16. The sheet pile panel of claim 15, wherein the stiffening strip has an outer surface, which is flush with the outer surface of said central section.

17. The sheet pile panel of claim 15, wherein the stiffening strip has an outer surface, which protrudes beyond the outer surface of the central section.

18. The sheet pile panel of claim 16, wherein the outer surface of the stiffening strip has a reflective surface disposed thereon.

19. The sheet pile panel of claim 17, wherein the outer surface of the stiffening strip has a reflective surface disposed thereon.

20. The sheet pile panel of claim 18, wherein the sheet pile panel is made of plastic and the stiffening strip is made of metal.

21. The sheet pile panel of claim 19, wherein the sheet pile panel is made of plastic and the stiffening strip is made of metal.

22. The sheet pile panel of claim 18, wherein the sheet pile panel and the stiffening strip are both made of metal.

23. The sheet pile panel of claim 19, wherein the sheet pile panel and the stiffening strip are both made of metal.

24. The sheet pile panel of claim 18, wherein the sheet pile panel and the stiffening strip are both made of plastic.

25. The sheet pile panel of claim 19, wherein the sheet pile panel and the stiffening strip are both made of plastic.

26. The sheet pile panel of claim 21, wherein the outer surface of stiffening strip is wider than the width of the slot.

* * * * *